United States Patent [19]

Voegel et al.

[11] Patent Number: 4,645,582

[45] Date of Patent: Feb. 24, 1987

[54] CURRENT DISTRIBUTION ASSEMBLY FOR ELECTRODE USED IN AN ELECTROLYTIC REDUCTION CELL

[75] Inventors: Robert L. Voegel; Kenton B. Wright, both of Newburgh, Ind.

[73] Assignee: Aluminum Company of America, Pittsburgh, Pa.

[21] Appl. No.: 796,868

[22] Filed: Mar. 21, 1986

[51] Int. Cl.[4] ..... C25D 17/12

[52] U.S. Cl. ..... 204/286; 204/67; 204/243 R; 204/294; 204/297 R

[58] Field of Search ..... 204/286, 67, 243 R, 204/243 M, 244, 245, 246, 247, 280, 294, 297 R

[56] References Cited

U.S. PATENT DOCUMENTS 4,552,638 11/1985 Voegel et al. ..... 204/286

4,557,817 12/1985 Voegel et al. ..... 204/286

*Primary Examiner*—G. L. Kaplan

*Attorney, Agent, or Firm*—Andrew Alexander; John P. Taylor

[57] ABSTRACT

An improved electrode assembly is disclosed for use in a cell for the production of metal by electrolytic reduction comprising a nonmetallic conductive electrode having a top surface and a central current carrying support shaft received in a central bore extending axially downward from the top surface. Conductive fin members extend radially from the central support shaft in the electrode, the fin members comprising a plurality of gate members extending radially from the central shaft adjacent a top surface of the electrode and wing members extending from the gate members downwardly into the electrode from the top surface. The gate members are provided with tapered surfaces extending toward the center of the electrode whereby expansion of both the nonmetallic and the metallic portions of the electrode assembly will enhance the electrical contact between the wing members and the nonmetallic portions of the electrode to thereby further minimize the voltage drop in the electrode. The electrode assembly is further provided with braces for the gate members to inhibit cracking of the gate members during thermal expansion of the electrode assembly. Collar means, which surround the central shaft, are provided with divergently tapered interlocking means which will serve to retain the electrode assembly together despite inadvertent cracking of either the metallic or nonmetallic portions of the electrode assembly.

32 Claims, 18 Drawing Figures

CURRENT DISTRIBUTION ASSEMBLY FOR ELECTRODE USED IN AN ELECTROLYTIC REDUCTION CELL

CROSS REFERENCE TO RELATED APPLICATIONS

This application is related to application Ser. No. 670,077, filed Nov. 13, 1984 and now U.S. Pat. No. 4,552,638 and to application Ser. No. 670,078, filed Nov. 13, 1984 and now U.S. Pat. No. 4,557,817.

BACKGROUND OF THE INVENTION

1. Field of the Invention

This invention relates to an improved electrode assembly used in the production of metal in electrolytic reduction cells. More particularly, this invention relates to further improvements in the current distribution assembly of an electrode used in an electrolytic reduction cell.

2. Description of the Prior Art

In the production of metal, such as aluminum, in an electrolytic reduction cell, anodes and cathodes are used which are constructed principally of conductive material, such as carbon, which will conduct the high currents used for the electrolytic reduction to the molten salt bath in the cell. Carbon electrodes are normally used to avoid contamination of the bath with foreign metals and to lower necessary reduction voltage.

The current is normally carried to the electrodes by large conductor busses which, in the case of the anode is, in turn, directly connected to the anode via a metal rod which also functions as a mechanical support for the anode as it is lowered or raised in the cell and incidentally as a cooling heat sink. The need for the anode to function as a heat sink varies as cell current density changes.

Conventionally, the anode is attached to the metallic rod by inserting the rod into a central bore formed in the top of the anode. An electrically conducting ram mix may then be placed into the space between the rod and the bore in the anode. This connection, however, can be less than satisfactory from a mechanical standpoint, speed of assembly, and electrically as well by providing a higher resistance at the interface. This problem has been partially addressed in the prior art. For example, German Patent No. 1,187,807 discloses a carbon anode having one or more cavities to receive a metal stub or rod. The surfaces of the cavities have grooves or teeth to increase the surface area which is said to provide better conductivity of the current form the rod into the anode.

German Patent No. 1,937,411 provides for a cast iron structure to be poured around a steel stub placed in the end of a carbon anode. The purpose of the cast iron structure, apparently, is to spread the current distribution across the top surface of the anode, as well as to lock the metal rod or stub to the anode by providing an under cutting in the sidewall of the recess cut into the top surface of the anode to receive the molten cast iron. The cast iron, as it solidifies, then provides a dovetail-like fit in the anode to prevent or inhibit the stub from separating from the anode.

While such arrangements do provide better mechanical bonding between the steel support rod and the anode, and do provide some current distribution improvements; the current distribution is still limited to an area or volume immediately surrounding the metal rod or, at best, only across the upper surface of the anode.

UK Patent Application GB No. 2,051,864A discloses an electrolytic cell having a carbon electrode with a plurality of conductive rods therein which may comprise aluminum. The rods can be connected to a common plate located at the top of the electrode.

Russian Patent No. 378,524 illustrates a carbon electrode structure having the usual central bore to receive a metal stub and also having a series of holes drilled into the carbon block parallel to the central bore to receive cast iron rods. Openings are then cut into the carbon between the central bore and the cast iron rods to permit cast iron bridge pieces to be poured to connect the cast iron rods to the metal stub. The purpose of the rods is stated to be to reduce power losses.

Despite these attempts to distribute the current more evenly in the electrode, there remained a need to optimize the distribution of current through an electrode such as, for example, from the central stub of an anode, or from a rod positioned within a cathode, to reduce voltage drops therebetween as well as to dissipate heat generated by such voltage drops which can otherwise result, for example, in burnoffs of the anodes. Our aforementioned related applications, cross-reference to which are hereby made, addressed these needs by providing current carrying assemblies in the electrode comprising fin members which extend radially from the center of the electrode and wing members which depend downwardly in the electrode from the fin members.

SUMMARY OF THE INVENTION

We have now found that the performance of the current carrying assemblies described and claimed in our parent patent applications may be further enhanced by certain improvements in the design of the current carrying assembly.

It is therefore an object of the invention to provide an improved electrode assembly for an electrolytic reduction cell having improved current distribution characteristics.

It is another object of the invention to provide an improved electrode assembly for an electrolytic reduction cell having one or more tapered conductive wing members depending from one or more conductive gate members spaced around an electrode current-carrying rod.

It is yet another object of the invention to provide an improved electrode assembly for an electrolytic reduction cell having one or more tapered conductive wing members depending from one or more conductive gate members spaced around an electrode current-carrying rod wherein the taper extends toward the center of the electrode to enhance electrical contact between the wing member and the nonmetallic portions of the electrode during operation of the cell.

It is a further object of the invention to provide an improved electrode assembly for an electrolytic reduction cell wherein conductive gate members spaced about an electrode current-carrying rod are provided with reinforcing members which extend from the gate member adjacent the current-carrying rod at an angle toward the bottom of the wing member depending from the gate member.

It is yet a further object of the invention to provide an improved electrode assembly for an electrolytic reduction cell wherein dovetail flute members extend from the current-carrying rod between the gate members to retain the nonmetallic electrode in place against the rod and gate members if the collar surrounding the rod and attached to the gate members should separate into more than one piece.

It is a still further object of the invention to provide an improved electrode assembly for an electrolytic reduction cell wherein the collar surrounding the current-carrying rod is provided with weak points at the center of dovetail flute members designed to hold the nonmetallic electrode portion of the electrode assembly together against the collar whereby cracking of the collar at the weak points will not permit separation of metallic portions of the electrode assembly from the nonmetallic portions.

These and other objects of the invention will be apparent from a reading of the description and accompanying drawings.

In accordance with the invention, an improved electrode assembly is provided for use in a cell for the production of metal by electrolytic reduction comprising a nonmetallic conductive electrode having a top surface and a central current carrying support shaft received in a central bore extending axially downward from the top surface. Conductive fin members extend radially from the central support shaft in the electrode, the fin members comprising a plurality of gate members extending radially from the central shaft adjacent a top surface of the electrode and wing members extending from the gate members downwardly into the electrode from the top surface. The gate members are provided with a taper extending toward the center of the electrode whereby expansion of both the nonmetallic and the metallic portions of the electrode assembly will enhance the electrical contact between the wing members and the nonmetallic portions of the electrode to thereby further minimize the voltage drop in the electrode, permit the electrode to run cooler, and reduce the number of burnoffs.

DETAILED DESCRIPTION OF THE INVENTION

Figure 1:
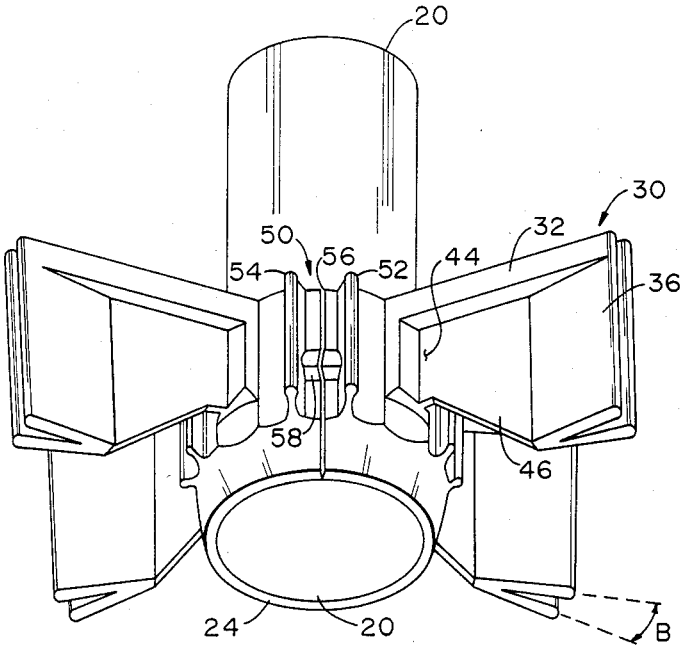
FIG. 1 is a perspective view of one embodiment of the improved current distributing fin assembly of the invention.
Figure 4:
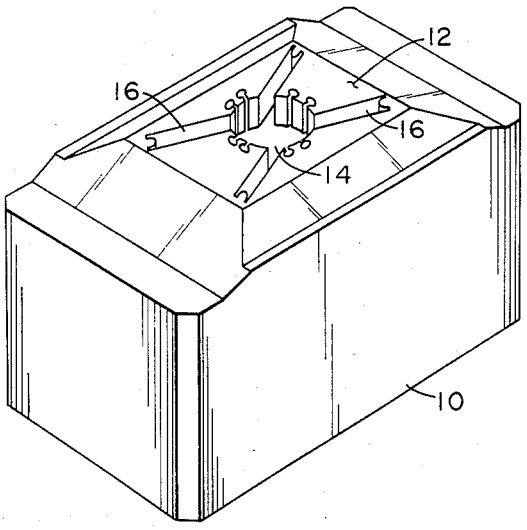
FIG. 4 is a top view of the improved electrode of the invention having the improved current distributing fin assembly mounted therein.

Referring now particularly to FIGS. 1 and 4, the electrode assembly of the invention is shown comprising a nonmetallic electrode block 10 having a central bore 14 formed in the top portion thereof to receive a central support shaft 20. In accordance with the invention, nonmetallic electrode 10 is formed with portions 16 which radially extend from bore 14 to permit the fin assembly 30 shown in FIG. 1 to be cast in situ therein around central support shaft 20 thereby avoiding the need for secondary machining of the nonmetallic electrode body.

It will be noted herein that electrode 10 is illustrated in the form of an anode. However, the current distribution and heat dissipation characteristics of the invention described herein can be used in cathode construction as well. The current carrying assembly of the invention will therefore be referred to as an electrode assembly although illustrated in the form of an anode.

In the preferred embodiment, nonmetallic electrode 10 comprises a carbon block although the use of other types of conductive electrode material, such as combinations of metals and metal oxides, which have been formed into materials relatively inert to the molten metal, and salt normally found in an electrolytic reduction cell, may be used. The use of the term nonmetallic is, therefore, intended to include such combinations of metallic and nonmetallic electrode materials as well. Design configurations may vary slightly depending upon the electrode material used.

Central support shaft 20 may comprise a steel shaft which provides both mechanical support and electrical connection from an external power supply to electrode 10. Central support shaft 20 is secured in bore 14 of electrode 10 by pouring molten metal, such as cast iron, around the shaft 20 which is formed slightly smaller than bore 14 to thereby form, in situ, a collar of metal 24 around shaft 20.

Conventionally then, the current in shaft 20 is distributed to electrode 10 via the contact between the cast iron metal in bore 14 and the adjoining area of nonmetallic electrode, e.g., carbon or the like. This type of construction can, however, result in considerable generation of heat near the metal-nonmetallic electrode interface which, in turn, can result in premature burnoff. Thus, in accordance with the invention described and claimed in our parent applications, fin assemblies 30 have been provided comprising metal members which are contiguous or adjacent to shaft 20. This may be accomplished by forming electrode 10 with cutaway portions, i.e., molded openings 14 and 16, to permit the formation of fin assemblies 30 in situ therein by the pouring of molten metal, such as cast iron, into the openings formed in the top surface of electrode 10. This serves to provide the necessary mechanical locking of shaft 20 into electrode 10 as well as providing, where appropriate, good electrical contact between shaft 20 and fin assembly 30.

Fin assembly 30 comprises gate members 32, which extend from shaft 20 radially adjacent top 12 surface of electrode 10, and wing members 34 which extend downwardly from gate members 32 into electrode 10 and toward the bottom edge 18 thereon. This permits the current in shaft 20 to flow through the gate members 32 into the wing members 34, from which the current flows into nonmetallic electrode 10 in contact therewith, thereby providing a distributed current flow.

Fin assemblies 30, while usually symmetrically positioned radially around collar 24 and central shaft 20, preferably extend outwardly toward the corners of electrode block 10 to maximize the current distribution to the lateral extremities of electrode block 10. Thus, where electrode block 10 is a non-square rectangle, or of non-circular curved shape, the fin assemblies will not extend out at angles of 90° from adjacent fin assemblies although they will be typically connected to collar 24 at points which are approximately 90° apart radially as shown in FIGS. 1 and 4.

Figure 2:
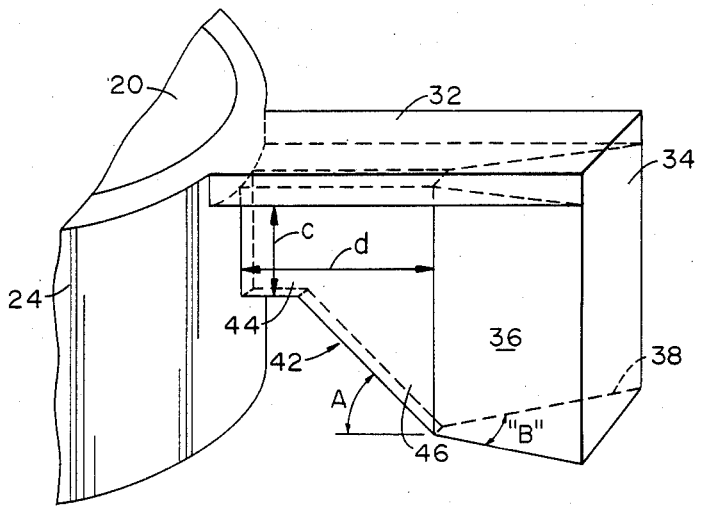
FIG. 2 is an enlarged fragmentary perspective view of a portion of the fin assembly shown in FIG. 1.

In accordance with a principal aspect of the present invention, wing members 34 are provided with tapered side walls or side surfaces 36 and 38 to provide for more effective surface contact between metallic wing member 34 and electrode 10. Side surfaces 36 and 38 may be planar or they may be slightly convex, depending upon the particular design. The angle of the taper, angle B, as shown in FIGS. 1 and 2, will vary from a minimum of about 2° to a maximum of about 60°. Typically, angle B will vary from about 8° to 55°. It should be noted that angle B may be slightly larger at the bottom of wing 34 than at the top.

As stated above, the purpose of providing a taper in the side walls 36 and 38, which provides a convergence in the direction of the center of the electrode, is to provide more effective surface contact between sidewalls 36 and 38 of wing member 34 and electrode block 10. This has been found to be necessary due to the difference in the coefficients of expansion of the metal forming fin assembly 30 and nonmetallic electrode block 10.

The choice of angle B will be influenced by the operating temperature of the cell, i.e., the temperature of both fin assembly 30 and electrode 10; the thermal expansion rates for the materials used for both fin assembly 30 and electrode 10; the length of the non-tapered portion of the fin assembly; the thickness of fin assembly 30 and the taper of the wing portion from top to bottom; and the temperature of the electrode block at the time of pouring the cast iron to form fin assembly 30.

In general, since the slot expands with temperature increase while the cast iron shrinks as it cools to room temperature, the joint will be tightest at room temperature. However, any angle of B greater than about 4° to 5° will give a tight joint. Steeper angles will increase the tensile stress on the gate portion of the fin assembly with the problem becoming worse as the overall length of the fin assembly increases.

A fit pressure against the carbon of about 200 psi at operating temperatures is sufficient to overcome the contact resistance and the bridge or gate portion can be made strong enough to withstand the room temperature load of about 2000 psi. Practical wings can be designed in accordance with the invention with an angle B as high as 60°, with wings over 5 inches requiring lower angles and short wings, i.e., less than 3 inches, requiring steep angles. As wing length increases, however, the size of the cap or upper portion of the gate and the thickness of the wing must also increase to improve the internal resistance of the wing member.

The area size of the side surfaces 36 and 38 of wing member 34 will vary with the size of electrode block 10. Preferably, the total surface area of all of the tapered surfaces on all of the wing members should be from about 5 to 20% of the total bottom surface area of the electrode.

Figure 3A:
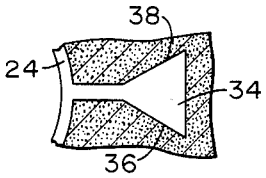
FIGS. 3A–3C are sequential fragmentary horizontal section views of one of the fin assemblies within a nonmetallic electrode as both the fin assembly and the nonmetallic portion of the electrode expand with heat.
Figure 3B:
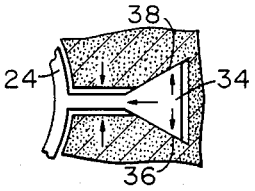

Typically electrode block 10 may comprise a carbon block which has been preformed with openings or portions 14 and 16 conforming to the shape of shaft 20 as well as a desired collar 24 surrounding shaft 20 and fin members 30. A steel shaft 20 is then typically inserted into bore 14 and cast iron is poured into the remainder of the openings 16 in electrode block 10 at above 1150° C. to form collar 24 and fin assemblies 30. This is exemplified in FIG. 3A. As the cast iron cools, it solidifies and begins to shrink at temperatures below 1100° C. in the directions of the arrows as shown in FIG. 3B.

Figure 1A:
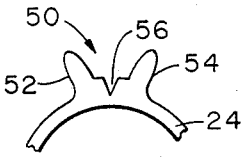
FIG. 1A is an enlarged fragmentary view of a portion of FIG. 1.
Figure 3C:
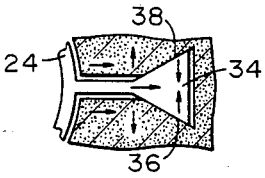

When the electrode assembly is inserted into an electrolytic bath at about 900° C., the metal again expands, as shown by the arrows within wing assembly 34 in FIG. 3C, although not to the original volume of FIG. 1A due to the lower temperature. However, in this instance, since the entire electrode assembly, not just the metallic wing assembly 34, is expanding—as shown by the arrows in electrode block 10 in FIG. 3C—the wing assembly surfaces 36 and 38 remain in contact with the tapered walls of electrode block 10 thus providing good electrical contact therebetween as well as good heat transfer over the entire warm-up temperature from room temperature up to the operating temperature of the cell.

The tapered surfaces of wing member 34 provide much improved mechanical support for electrode block 10, particularly during startup of the electrode, as well as providing a large surface area of electrical contact between the tapered sidewalls 36 and 38 of wing member 34 and the corresponding surfaces in electrode block 10 throughout the temperature range from startup to actual operating temperature. This has a locking effect to bind wing assembly 34 tightly against the tapered walls of electrode block 10.

Figure 5:
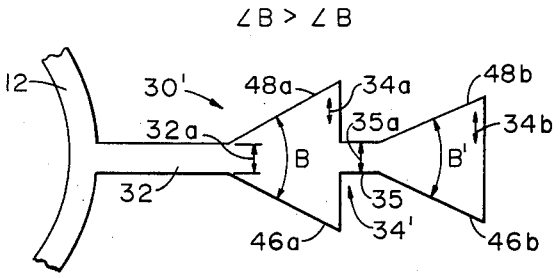
FIG. 5 is a fragmentary top view in cross-section of another embodiment of the invention.

Another embodiment of the tapered wing surface of the invention is illustrated in FIG. 5 wherein a modified fin assembly 30' comprises a gate assembly 32 and a modified wing assembly 34'. Wing assembly 34' comprises a first wing **34*a* having tapered surfaces 46*a* and 48*a* defining an angle B as in the previously described embodiment. However, in this embodiment, wing 34*a* does not extend out as far as wing 34 in the previous embodiment. Rather, wing 34*a* terminates in a bridge 35 which links wing 34*a* with a second wing 34*b* having tapered side surfaces 46*b* and 48*b*** giving a lower casting weight than a single wing of the same overall length.

It will be noted immediately, however, due to the exaggerated illustration, that angle B', the convergence angle of tapered surfaces **46*b* and 48*b*, is smaller than angle B. This embodiment compensates for the differences in expansion and contraction of the molten metal such as cast iron which will be used to form wing member 34'. Since the longer the distance from any point on wing member 34' to collar 24, the greater will be the shrinkage or the expansion, this embodiment seeks to compensate for such differences by changing the angle B' to a smaller angle to permit side surfaces 46*b* and 48*b*** to travel inwardly and outwardly a greater distance than tapered side surfaces 46*a* and 48*a* while still maintaining approximately the same contact force against the corresponding nonmetallic surface of electrode 10. In this regard, it should be also kept in mind that the surface area which is the farthest from central shaft 20 and collar 24 is the most valuable from the standpoint of current distribution.

Figure 2A:
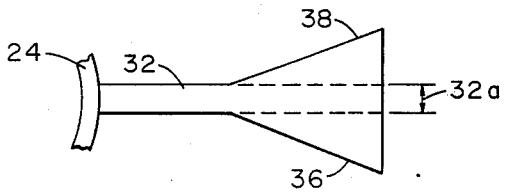
FIG. 2A is a fragmentary top view of a portion of FIG. 2

An alternate compensation method uses changes in wing root thicknesses 32*a* and 35*a* (FIGS. 2A and 5) to match contact forces, which may allow angles B and B′ to be equal when wing root 35*a* is greater than root 32*a*.

In the preferred aspects of this embodiment, angles B and B′ should vary from about 2° to 55° with angle B′ usually maintained at about 70 to 80% of angle B when the linear or horizontal root widths (32*a* and 35*a*) of wings 34*a* and 34*b* are about the same.

Referring again to FIGS. 1 and 2, another aspect of the invention is generally illustrated at 42 comprising a brace or reinforcement member comprising a straight portion 44 which depends downwardly from gate member 32 a distance C as depicted in FIG. 2. This amount may vary from 0 to about 7 inches depending upon the overall depth of wing member 34. Straight portion 44 typically may extend horizontally a portion of the distance between collar 24 and wing member 34 with an angle portion 46 extending the remainder of the distance.

The purpose of brace 42 is to strengthen or reinforce gate member 32 in view of the strains which may be placed thereon during expansion of the electrode block 10 and the metallic portions of the electrode assembly, i.e., gate member 32 and wing members 34 and also provide space for the wing to be pulled into. Particularly when the expansion of the electrode block expands against the lower portion of wing member 34, the gate member, absent such reinforcement, may tend to crack on its underside as the bottom of wing assembly 34 is urged outward, i.e., creating a circular reaction moment.

Angle A, shown in FIG. 2, could actually be 0 with the brace extending completely between wing 34 and collar 24 from top to bottom. This would be the most efficient electrically and the strongest physically, but would weaken the electrode the most as well as taking the most cast iron.

Therefore, angle A which angle portion 46 defines with the horizontal, as shown in FIG. 1, will be dependent on the length d of straight portion 44 as well as the depth of wing member 34. Angle A may vary from 0° to 85° and is selected to not create any binding between brace member 42 and electrode block 10 during operation at electrolytic cell bath temperatures.

It should be further noted here that portion 44 of brace 42 may be eliminated with angle portion 46 extending directly from collar 24 to the bottom of wing member 34. In such a case, distance C will represent the depth of the commencement of angle portion 46 at collar 24.

It will also be noted, as shown in FIG. 3C, that the sides of brace member 42 are not tapered toward collar 24 and thus the cooling of the initially cast metal causes brace member 42 to shrink away from contact with electrode block 10. Member 42 may be straight or even may taper slightly away from collar 24.

Figure 1B:
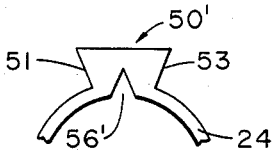
FIG. 1B is an enlarged fragmentary view of an alternate embodiment to that shown in FIGS. 1 and 1A.

Turning back to FIGS. 1 as well as FIGS. 1A–1B, another aspect of the invention is noted wherein interlocking means herein illustrated as dovetail members 50 are formed as a part of collar 24 around shaft 20 to mechanically lock electrode block 10 and the metallic current distributing assembly together. Dovetail members 40 are radially spaced around collar 24 between fin assemblies 30. Four dovetail members are thus shown in the typical design shown in FIG. 1 with each of the dovetail members 50 radially spaced approximately 45° from each fin assembly 30.

The presence of dovetail members 50 compensates for or anticipates the possibility of cracking of either the metallic current distribution assembly—particularly collar 24—or the nonmetallic electrode block 10 during heating to operating temperature and the resultant strains which may develop due to thermal expansion of the dissimilar materials. Thus, should the electrode block 10, e.g., the carbon block, crack at the end of fin assembly 30 (the points of smallest distance from the metallic current distributing assembly to the exterior of the nonmetallic electrode 10), dovetail assembly 50 will hold the pieces of the nonmetallic electrode block 10 against the fin assemblies 30 thus permitting continued operation or—at the very least—allowing the electrode to be removed intact and replaced without the need to manually remove individual pieces of electrode block, e.g., carbon, from the molten salt bath of the cell.

Conversely, if the metal portion, e.g., collar 24, cracks, the design of dovetail member 50 permits retention of the entire electrode assembly together either for continued use or for replacement of the electrode assembly. This design of dovetail member 50, as best seen in the alternative embodiments of FIGS. 1A and 1B, directs the cracking of collar means 24 to occur at the dovetail itself, i.e., to sever the dovetail, whereby divergent or tapered fingers 52 and 54 of the dovetail will both still engage electrode block 10 even though they are severed from one another. As shown in FIG. 1A, the opening or wedge 56 between fingers 52 and 54 extends deeper into collar 24 thus making this, in effect, the thinnest or weakest portion of collar 24 to thus direct the cracking to occur here rather than elsewhere. As shown in FIG. 1, the fingers 52 and 54 may be joined by a lug member 58 to provide safety against separation of carbon and joint prior to placement in the cell. Lugs 58 may be placed at any convenient point.

In FIG. 1B, an alternate embodiment is illustrated wherein an inner weakness or wedge opening is created in dovetail 50′ at 56′ with tapered edges 51 and 53 performing the same interlocking function as fingers 52 and 54. This embodiment would, however, require the use of additional forms to create the internal wedges 56′ during initially pouring of the metal.

Figure 6:
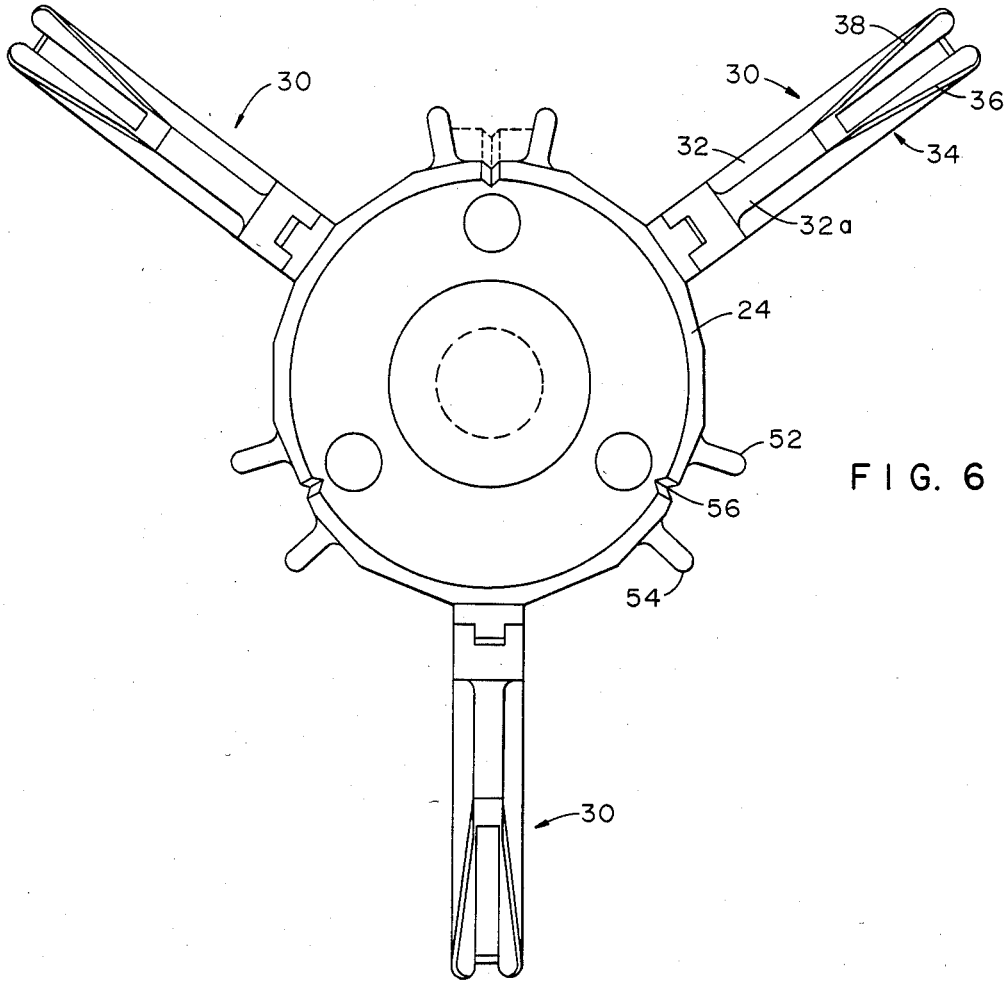
FIG. 6 is a fragmentary top view in cross-section of yet another embodiment of the fin assembly of the invention.
Figure 7:
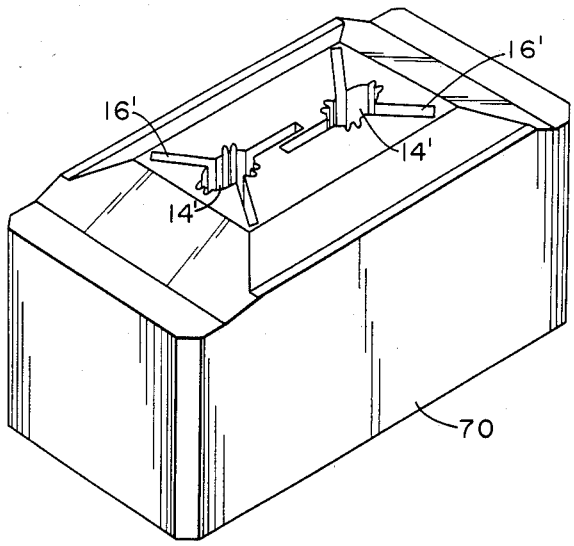
FIG. 7 is a fragmentary perspective view of an electrode which receives the fin assembly of FIG. 6.

In FIGS. 6 and 7, another embodiment of the invention is illustrated wherein three fin assemblies 30 are spaced around collar 24. An electrode block 70 is provided with two bores 14′ each having three formed cavities 16′ connected thereto whereby two of the current carrying assemblies shown in FIG. 6 may be formed therein with a fin assembly 30 extending toward each corner of the electrode block 70.

Figure 8:
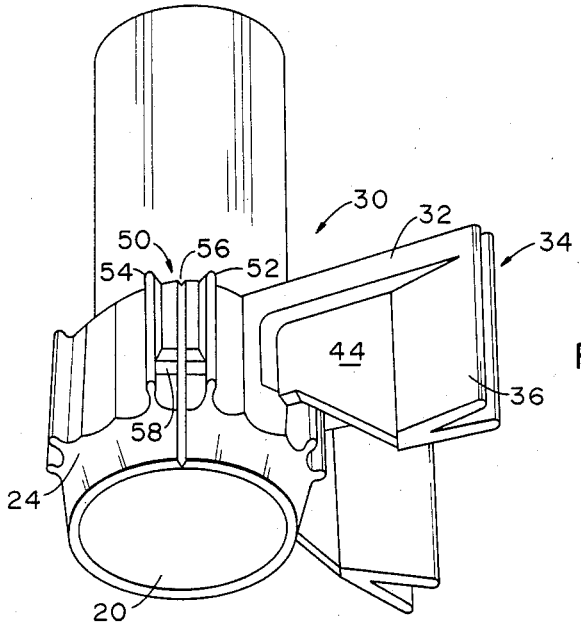
FIG. 8 is a perspective view of another embodiment of the fin assembly of the invention.
Figure 10:
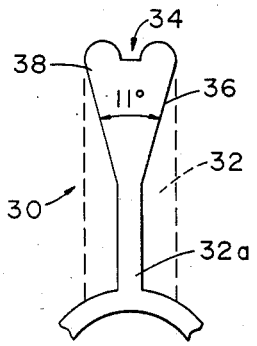
FIG. 10 is a fragmentary top view in cross-section of a part of the fin assembly of FIG. 8.
Figure 9:
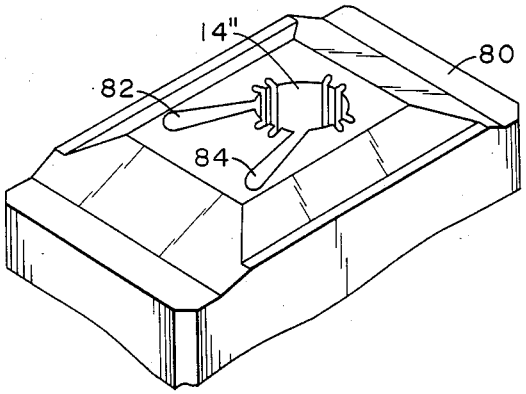
FIG. 9 is a fragmentary perspective view of an electrode which receives the fin assembly of FIG. 8.

FIGS. 8–10 illustrate yet another embodiment of the invention wherein a current carrying assembly is formed in electrode block 80 comprising two fin assemblies 30. In this embodiment single bore 14″ may be located offset to the center of electrode 80 if desired with the two fin assemblies formed in cavities 82 and 84.

Figure 11:
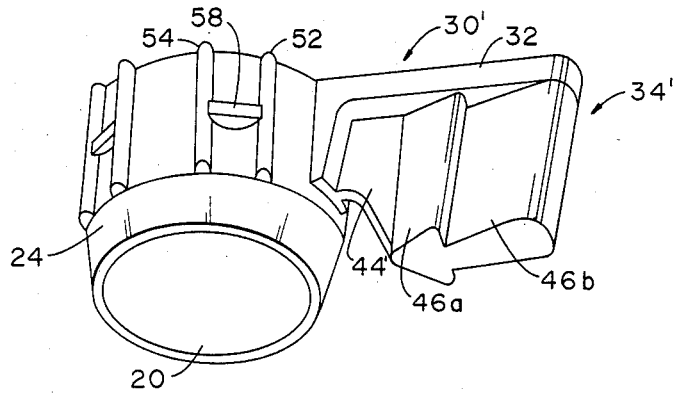
FIG. 11 is a perspective view of another embodiment of the fin assembly of the invention.
Figure 12:
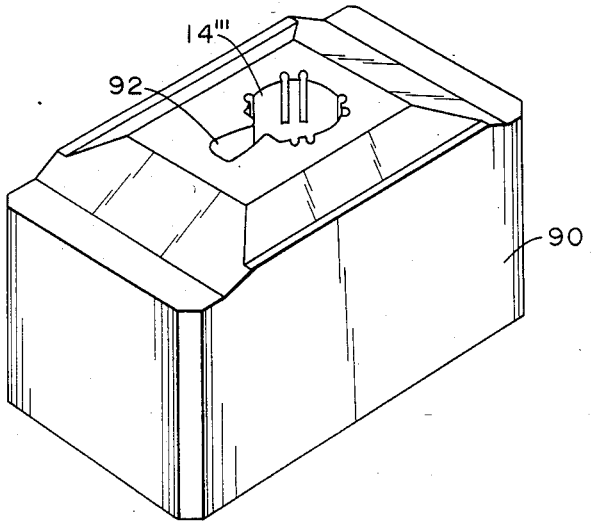
FIG. 12 is a fragmentary perspective view of an electrode which receives the fin assembly of FIG. 11.
Figure 13:
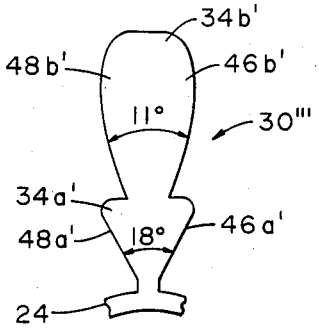
FIG. 13 is a fragmentary top view in cross-section of a part of the fin assembly of FIG. 11.

FIGS. 11–13 show still another embodiment of the invention wherein a single fin assembly is formed in cavity 92 of electrode block 90 in communication with center bore 14''' which again may be located off center to the middle of electrode 90. In this instance fin assembly 30'' is similar to fin assembly 30' in that two tapered wings 34*a'* and 34*b'* are used. It will be noted that tapered surfaces 46*a'* and 48*a'* on wing 34*a'* converge toward collar 24 at a different angle than do tapered surfaces 46*b'* and 48*b'* on wing 34*b'*. It will also be noted that wing 34*b*, which will be located a further distance than wing 34*a'* from collar 24 and the central shaft (not shown) from which current will flow, is longer than wing 34*a'*. This will, in turn, provide a larger area for current distribution through wing 34*b* than through wing 34*a'* which, as earlier discussed, is desirable since the greatest current loss in prior art electrodes not having such current distribution assemblies occurs at the point spaced farthest from the central source of current.

Other shapes may also be provided for fin assembly 30 including branch wing members attached to other wing members if desired to further distribute the current evenly throughout the electrode.

Thus, the invention provides an improved electrode with enhanced current distribution capabilities due to the better contact between the electrode block and the tapered portions of the wing members. Furthermore, the tapered wing members, angular bracing of the gate members, and the interlocking or dovetail means impart improved mechanical strength characteristics to the assembly.

Having thus described the invention, what is claimed is:

1. An improved electrode assembly for use in a cell for the production of metal by electrolytic reduction in a molten salt bath comprising: a nonmetallic conductive electrode having a top surface; a central current carrying metallic support shaft received in a central bore in said electrode extending axially downward from said top surface; and metallic fin members extending radially from said central support shaft in said electrode, said metallic fin members comprising a plurality of gate members extending radially from said central shaft adjacent said top surface of said electrode and wing members extending from said gate members downwardly into said electrode from said top surface; said wing members each having tapered surfaces extending in a converging direction toward said central shaft to increase the surface area of electrical contact between said wing members and said nonmetallic conductive electrode at operating temperatures and to enhance the mechanical strength of said electrode assembly.

2. The electrode assembly of claim 1 wherein said tapered surfaces on said wing members lie in planes which extend downwardly in said electrode from said top surface and radially from said center shaft.

3. The electrode assembly of claim 2 wherein said tapered surfaces on opposite sides of each of said wing members define convergent angles of from 2° to 60°.

4. The electrode assembly of claim 3 wherein the total surface area of all of said tapered surfaces on said wing members defines a surface area in contact with the nonmetallic portions of said electrode of from 5 to 20% of the total bottom surface area of said electrode.

5. The electrode assembly of claim 3 wherein said tapered surfaces comprise a plurality of tapered surfaces on both sides of each of said wing members.

6. The electrode assembly of claim 3 wherein said nonmetallic conductive electrode comprises carbon and said fin assemblies are formed by pouring molten metal into openings formed in said carbon electrode around said central support shaft.

7. The electrode assembly of claim 6 wherein said metallic fin assemblies comprise cast iron poured in molten form into said openings in said carbon electrode.

8. The electrode assembly of claim 1 wherein said gate members include a brace member having an angular portion which depends downwardly in said electrode at an angle from a point adjacent said central shaft to the bottom of said wing member closest to said central shaft to provide additional strength to said gate member against cracking due to thermal expansion of the dissimilar materials of said electrode assembly.

9. The electrode assembly of claim 8 wherein said brace member also includes a horizontal portion which extends to said wing member from collar means surrounding said central shaft.

10. The electrode assembly of claim 8 wherein said angular portion of said brace member defines an angle with the horizontal of from 0° to 85°.

11. The electrode assembly of claim 1 wherein collar means are formed in said central bore surrounding said central shaft and said fin assemblies radially extend outwardly from said collar means.

12. The electrode assembly of claim 11 wherein a plurality of interlocking means extend radially into said nonmetallic electrode from said collar means to hold the portions of said electrode assembly together should inadvertent cracking occur either in the metallic or nonmetallic portion of said electrode assembly.

13. The electrode assembly of claim 12 wherein said interlocking means are symmetrically dispersed radially around said collar means inbetween said fin assemblies.

14. The electrode assembly of claim 13 wherein said interlocking means comprise dovetail means divergently extending outwardly from said collar means to provide interlocking action of said nonmetallic electrode against said collar means to retain said electrode assembly together should inadvertent cracking occur.

15. The electrode assembly of claim 14 wherein means are provided to direct cracking of said collar means adjacent the center of said interlocking means whereby said interlocking means will have maximum effectiveness in holding said electrode assembly together should inadvertent cracking of said collar means occur.

16. The electrode assembly of claim 15 wherein said means to direct cracking of said collar means comprise thinning of said collar means adjacent the center of said interlocking means.

17. The electrode assembly of claim 16 wherein said nonmetallic conductive electrode comprises carbon.

18. The electrode assembly of claim 17 wherein said interlocking means are formed by pouring molten metal into openings formed in said nonmetallic electrode.

19. The electrode assembly of claim 18 wherein said molten metal comprises cast iron.

20. The electrode assembly of claim 19 wherein said cast iron contains greater than 2.5 wt. % carbon to promote volume growth of said interlocking means as carbon diffusion results in graphite precipitation whereby said growth will tighten the carbon-cast iron joints of said interlocking means in said electrode assembly.

21. The electrode assembly of claim 19 wherein said central metallic support shaft is placed in said central bore before said molten metal is poured into said openings whereby said cast iron fin assembly comprising said tapered wing members is contiguous with said cast iron collar means surrounding said central support shaft and said interlocking means to provide enhanced mechanical strength and current distribution to said assembly.

22. An improved electrode assembly for use in a cell for the production of metal by electrolytic reduction in a molten salt bath comprising:

(a) a carbon electrode having a top surface an openings formed therein to receive molten metal current distributing means;

(b) a central current carrying metallic support shaft received in a central bore in said electrode extending axially downward from said top surface;

(c) metallic collar means surrounding said central support shaft;

(d) interlocking means radially extending outwardly from said collar means into said carbon electrode, said interlocking means including divergent means extending into said electrode to interlock said carbon electrode with said collar means; and (e) metallic fin members extending radially from said collar means said metallic fin members comprising:

(i) a plurality of gate members extending radially from said central shaft adjacent said top surface of said carbon electrode; and (ii) wing members extending from said gate members downwardly into said carbon electrode from said top surface, said wing members comprising tapered surfaces extending downwardly in said electrode and extending radially at a converging angle toward the center of said electrode, whereby said tapered surfaces on said metallic wing members will maintain electrical contact with adjoining carbon electrode surfaces during heating of said electrode to operating temperatures during expansion of said metallic wing members and said carbon electrode.

23. The electrode assembly of claim 22 wherein said gate members each include a brace member portion which depends downwardly in said electrode between said collar means and the bottom of said wing member closest to said collar means to provide additional strength to said gate member against cracking due to thermal expansion of the metal and carbon materials of said electrode assembly.

24. The electrode assembly of claim 23 wherein said brace member portion further comprises an angular portion which depends downwardly in said electrode from a point adjacent said collar means at an angle to the bottom of said wing member closest to said collar means to provide clearance for shrinkage of said wing member towards said collar member.

25. The improved electrode assembly of claim 23 wherein said electrode assembly functions as a cathode.

26. The improved electrode assembly of claim 23 wherein said electrode assembly functions as an anode.

27. The electrode assembly of claim 23 wherein said cast iron contains greater than 2.5 wt. % carbon to promote volume growth of said interlocking means as carbon diffusion results in graphite precipitation whereby said growth will tighten the carbon-cast iron joints of said interlocking means in said electrode assembly.

28. The electrode assembly of claim 23 wherein said central metallic support shaft is placed in said central bore before said molten metal is poured into said openings whereby said cast iron fin assembly comprising said tapered wing members is contiguous with said cast iron collar means surrounding said central support shaft and said interlocking means to provide enhanced mechanical strength and current distribution to said assembly.

29. An improved electrode assembly for use in a cell for the production of aluminum by electrolytic reduction in a molten salt bath comprising:

(a) a nonmetallic conductive electrode having a top surface;

(b) a central current carrying metallic support shaft received in a central bore in said electrode extending axially downward from said top surface;

(c) central collar means surrounding at least a portion of said central support shaft;

(d) interlocking means radially extending from said collar means into said nonmetallic electrode;

(e) a plurality of gate members extending radially from said collar means adjacent said top surface of said electrode toward the corners of said electrode, said gate members being radially interspersed between said interlocking means; and (f) wing members extending from said gate members downwardly into said electrode from said top surface, said wing members each having a plurality of tapered surfaces extending in a converging direction toward said collar means to increase the surface area of electrical contact between said wing members and said nonmetallic conductive electrode at operating temperatures and to enhance the mechanical strength of said electrode assembly.

30. The electrode assembly of claim 29 wherein said wing members comprise a first set of tapered surfaces defining a first set of convergent angles and at least one additional set of tapered surfaces defining different angles of convergence.

31. The electrode assembly of claim 30 wherein said at least one additional set of tapered surfaces is spaced a greater distance from said collar means than said first set and defines a smaller angle of convergence than said first set of tapered surfaces.

32. The electrode assembly of claim 30 wherein said at least one additional set of tapered surfaces is spaced a greater distance from said collar means than said first set and defines a smaller angle of convergence than said first set of tapered surfaces and a larger surface area than said first set of tapered surfaces.

* * * * *